US009187222B2

(12) United States Patent
Bennett

(10) Patent No.: US 9,187,222 B2
(45) **Date of Patent: *Nov. 17, 2015**

(54) SOFT DRINK CONTAINER SUPPORTING ADDITIVE CONTAINMENT AND SELECTIVE RELEASE

(71) Applicant: ENPULZ, L.L.C., Chicago, IL (US)

(72) Inventor: James D. Bennett, Hroznetin (CZ)

(73) Assignee: Enpluz, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/017,180

(22) Filed: Sep. 3, 2013

(65) Prior Publication Data

US 2014/0053951 A1 Feb. 27, 2014

Related U.S. Application Data

(63) Continuation of application No. 12/482,572, filed on Jun. 11, 2009, now Pat. No. 8,522,841.

(60) Provisional application No. 61/060,695, filed on Jun. 11, 2008.

(51) Int. Cl.

| | |
|---|---|
| ***B65B 1/04*** | (2006.01) |
| ***B65D 51/28*** | (2006.01) |
| ***B67D 1/00*** | (2006.01) |
| *B67D 1/08* | (2006.01) |

(52) U.S. Cl.

CPC ..... *B65D 51/2814* (2013.01); *B65D 51/2821* (2013.01); *B67D 1/0034* (2013.01); *B67D 1/0041* (2013.01); *B65D 51/285* (2013.01); *B67D 2001/082* (2013.01)

(58) Field of Classification Search

CPC B65B 51/28; B65B 51/2814; B65B 51/2821; B65B 51/2828; B65B 51/2835; B65B 51/2842; B65B 51/285

USPC ..... 141/21, 104, 297, 329, 330, 331, 332, 141/363, 366; 222/81; 206/217, 222, 568; 215/227; 220/521; 426/112

See application file for complete search history.

(56) References Cited

U.S. PATENT DOCUMENTS

2008/0286438 A1* 11/2008 Newell ..... 426/665

* cited by examiner

*Primary Examiner* — Jason K Niesz

(74) *Attorney, Agent, or Firm* — Garlick & Markison; Bruce E. Garlick

(57) ABSTRACT

A soft drink container includes a plurality of the additive storage containers, a plurality of additive contents contained in the additive storage containers, an additive storage selector, a base storage container containing at least one base liquid, and a mechanism operable to release the additive contents into the base liquid storage. The plurality of additive contents may include at least one of salts, spices, flavoring, color agents, odors, fragrances, vitamins, thickeners, enhancers, fruit distillers, preservatives and vitamins. The additive storage selector is operable to separately align each of the plurality of additive storage containers with an opening of the base storage container and is operable to release a selected additive content into the base liquid container. The additive storage selector may further include a piercer operable to pierce the base storage container.

20 Claims, 10 Drawing Sheets

SOFT DRINK CONTAINER SUPPORTING ADDITIVE CONTAINMENT AND SELECTIVE RELEASE

CROSS REFERENCE TO RELATED PATENTS/PATENT APPLICATIONS

The present U.S. Utility Patent Application claims priority pursuant to 35 U.S.C. §120, as a continuation, to the following U.S. Utility Patent Application which is hereby incorporated herein by reference in its entirety and made part of the present U.S. Utility Patent Application for all purposes:

1. U.S. Utility application Ser. No. 12/482,572, entitled "Soft Drink Container Supporting Additive Containment and Selective Release," filed Jun. 11, 2009, issuing as U.S. Pat. No. 8,522,841 on Sep. 3, 2013, which claims priority pursuant to 35 U.S.C. §119(e) to the following U.S. Provisional Patent Application which is hereby incorporated herein by reference in its entirety and made part of the present U.S. Utility Patent Application for all purposes:

a. U.S. Provisional Application Ser. No. 61/060,695, entitled "Soft Drink Container Supporting Additive Containment and Selective Release," filed Jun. 11, 2008.

BACKGROUND

1. Technical Field

The present invention relates generally to soft drinks; and more particularly to soft drinks packaged in containers.

2. Related Arts

Packaged soft drinks are typically marked with dates within which the soft drinks must be sold to guaranty freshness. These dates, e.g., best-before-date, use-by-date, etc., are critical for both manufacturers and sellers. Soft drinks, once prepared and canned/bottled have no optional shelf life control. Normally, the shelf life of soft drinks is predicted for specific storage ambient conditions. Canning or bottling of the soft drink in a container (of a certain material) helps to maintain the freshness of the soft drink, but only for the specified time. Container material development that may extend the shelf life of soft drinks is challenging.

Apart from the requirement of the suitable container material, maintaining storage conditions, e.g., temperature, humidity level, etc. are additional burdens on the manufacturers, distributors, and sellers of soft drinks. Deterioration during storage has serious impact on the quality of soft drink and improper storage may shorten the specified best-before-date or use-by-date specified by their manufacturers.

Flavoring, added to a soft drink base, e.g., carbonated water, causes the soft drink to have its unique flavor. The flavoring of the soft drink, unfortunately, degrades over time resulting in a tasteless, odorless, or unpleasant tasting soft drink. Carbonation can also be lost over time, resulting in flat soft drink. Any of these conditions will cause users to avoid the particular soft drink, brand of soft drink, or seller of the soft drink.

Currently the soft drinks are canned/bottled by their manufacturers. The manufacturing process includes fully incorporating all the ingredients resulting in the soft drinks ready to consume. Consumers have no choice or freedom of buying soft drinks of flavor other than what is available from the shop. Once soft drinks are canned or bottled the manufacturers do not have any control on further adding ingredients to attribute new flavor/taste or to rejuvenate for the degradation due to bio-chemical reactions inside the can or bottle. As consumers are often cautious towards health, salt and sugar content is critical. Current canning or bottling approaches do not provide any freedom for the consumer to control the saltiness or the sweetness levels of the soft drinks. Also the likes and dislikes of tastes and flavor differ from one location to other location and from country to country. The present way of delivering soft drinks does not meet the requirement of geographic dependence of liking on the taste and flavor by the consumers.

Some of the ingredients that are added during the manufacturing process either as preservatives or as flavor agents will react slowly with the container material developing an offensive odor. Also if the quality of the preservative degrades with time, some of the ingredients develop bacterial growth. In such cases the soft drinks under storage in the can or bottle may turn toxic over sufficiently long period of time resulting in poisoning effect.

Further limitations and disadvantages of conventional and traditional approaches will become apparent to one of ordinary skill in the art through comparison of such systems with the present invention.

BRIEF SUMMARY OF THE INVENTION

The present invention is directed to apparatus and methods of operation that are further described in the following Brief Description of the Drawings, the Detailed Description of the Invention, and the claims. Other features and advantages of the present invention will become apparent from the following detailed description of the invention made with reference to the accompanying drawings.

DETAILED DESCRIPTION OF THE DRAWINGS

Figure 1:
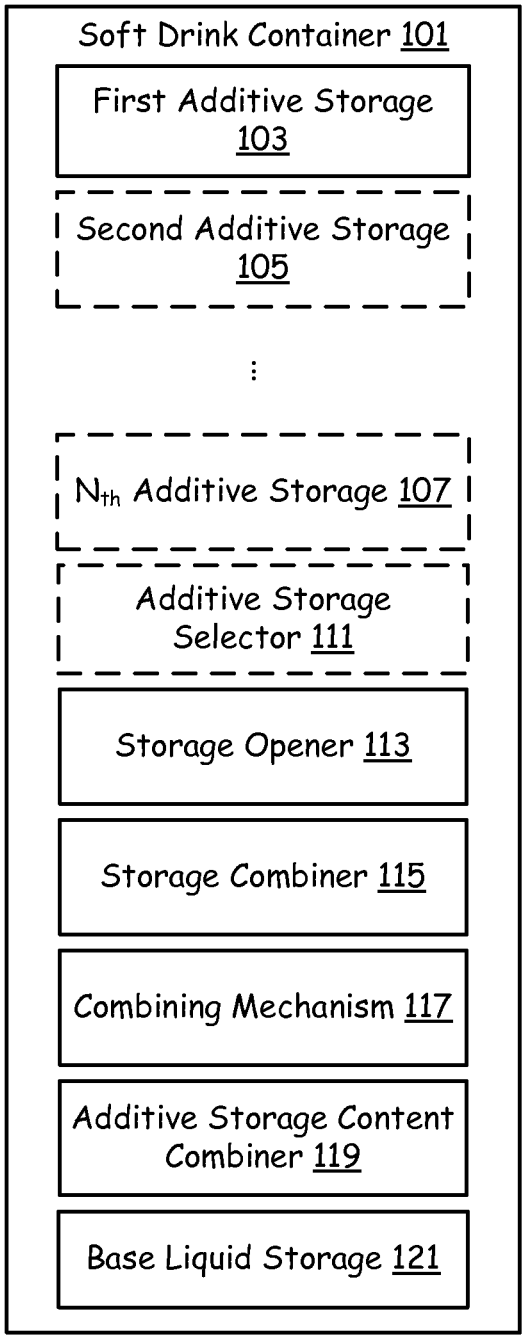
FIG. 1 is a block diagram of a soft drink container used to extend the shelf life by dispensing fresh additives into the cans or bottles containing the base liquid of the soft drinks in accordance with the present invention.

Prior techniques adopted to enhance the shelf life of soft drinks have serious disadvantage. The disadvantages relate to the amount of care required and the cost involved in enhancing shelf life. The cost involved is in terms of the canning/bottling process and the stringent requirement of the container (cans, bottles, etc.) material. If the container material is of substandard quality, it leads to storage related degradation of the soft drinks. If the seller of the soft drinks is lacking care towards maintaining the storage conditions of the delivered cans/bottles of the soft drinks, again it results in spoilage of the soft drinks at the accelerated rate.

Another challenge is the research in studying the chemical dynamics of interaction of each of the constituent ingredients and chemicals that are added into soft drinks. The soft drinks have various ingredients and chemicals mixed together, which often accelerates the bio-chemical degradation of the soft drinks. The bio-chemical reaction that takes place inside the soft drink contained in a container results in volatizing the fresh taste and odor at the faster rate. Some times the taste and odor turns offensive due to such degradation which consumer feels repulsive and give up consuming soft drinks from the manufacturer of such kind. Thus the current methods employed to enhance the shelf life of the soft drinks are laborious and not cost effective.

In accordance with the present invention preparing the soft drinks based on the market demand is an on-the-fly approach. This technique places all of the ingredients that are required to manufacture the soft drinks available in a container or storage in the soft drinks manufacturing plant. In another embodiment of the present invention the end consumer will be supplied with the base liquid and the required additive bags, using which the consumer or the seller of soft drinks will be able to instantly prepare fresh soft drinks of his choice of taste and flavor.

The present invention enables the manufacturer of the soft drinks making it possible to deliver the fresh soft drinks instantly to its customers or consumers, unlike the current method. According to the current method the delivered soft drinks will be bottled or canned on some previous dates not as fresh as the soft drinks from the method of the present invention.

In accordance with another embodiment of the present invention the consumer will be provided with a base liquid for the soft drinks along with the necessary additive bags containing additives of different flavors and tastes. The consumer is also provided with a simple means or mechanism for mixing the additive contents into the base liquid resulting in instant soft drinks. Associated recipe information (on the cans or bottles) enables the consumer to prepare the soft drinks to the liking of his taste/flavor.

The types of the additive bags supplied to the sellers or consumer of the soft drinks differs based on the incorporated additive dispensation mechanism in the base liquid container. In one embodiment of the present invention the additive bag is associated into the container cap assembly with the bag being aligned with (an injecting) cavity (hole). The consumer pierces the cavity and the additive bag using a piercer. During the piercing process the piercer pierces all the way down through the cavity foil creating a hole in the (base liquid container) cap, and tearing through the additive bag reaching the base liquid in the base liquid container. An example of a piercer is the drinking straw. The consumer shakes the can or the bottle containing the base liquid and consumes the soft drinks. In consuming the soft drinks the consumer uses the same drinking straw that is used in piercing the cavity and the additive bag (that is sandwiched).

In another embodiment of the present invention the base liquid container cap will have more than one additive bag such as sweetener bag, carbonating chemicals bag, fragrances bag, etc. each bag being sandwiched inside the (base liquid container) cap at different part and aligned with the respective cavities. In such case the consumer does multiple piercing (using drinking straw) through each of the cavities and the associated additive bags to release their contents. This kind of provision with multiple additive bags will give more freedom for the user to prepare instant soft drinks of his choice. For example for a consumer who wants sugar level lower than normal level can add sufficient amount of sweetener, likewise salt, etc.

In accordance with another embodiment of the present invention, a (soft drinks) server can serve a large group of people with instant and freshly prepared soft drinks. In that case the server can precisely control the dispensation of the additives in a required quantity into the base liquid. This feature is conveniently incorporated by having the additive bags associated with an additive bag container. The release of the additive contents is possible by applying force from the handle portion of the base liquid container and the additive bag container as discussed in figures of specific embodiment of the present invention. The server releases required quantity of additives precisely by reading a measurement scale.

In another embodiment of the present invention the consumer or the soft drinks server can release different additives into an additive content combiner in a required proportion to get the additive mixture. In this setup a storage combiner will have a plurality of the storage containers each labeled with the name of the additive content as going to be discussed with figures in the subsequent section. The additives will be selected using additive selector mechanism (e.g. a tap mechanism, manually or automatically). The additives will be flowed into the additive contents combiner from their storage containers and the additive mixture is thus formed. The additive mixture is then flowed to the based liquid container using another selector such as a tap (manually or automatically). The flowing of the additive mixture into the base liquid container will result in the soft drinks in the place of the base liquid. Finally the soft drinks will be ready to be served.

FIG. 1 is a perspective block diagram of a soft drink container used to extend the shelf life by dispensing fresh additives into the cans or bottles containing the base liquid of the soft drinks in accordance with the present invention.

The additive storage is the containers for the additive contents of different taste, flavor, and bio-chemical nature. Additives are filled from external into them after opening each of them using an opener mechanism. The additive storage selector mechanism is used to select an additive of specific taste and flavor in the instant preparation of the soft drinks. The storage combiner combines all the additive storage together in an assembly. New additive storage can be added into this storage combiner and the one that are not needed will be removed. The additive storage content combiner is a container used to combine all the required additives in a specified proportion to form an additive mixture. The additive mixture is released into a base liquid container resulting in soft drinks of required taste and flavor. In one embodiment the base liquid is stored in a separate storage like any other additives, which is selected and a specific amount of it is released into a container like cans or bottles. Into these cans or bottles additive contents or their mixture is flowed resulting in soft drinks of specific composition.

In order to achieve soft drinks of different taste and flavors, additives of different taste/flavors can be released into the additive storage content combiner. Thus the method of present invention facilitates an instant preparation of fresh soft drinks. Similarly a base liquid will also be selected from a variety of them in the respective storages suitable for different types of soft drinks in accordance with another embodiment of the present invention.

In FIG. 1 the soft drink container 101 is having, a plurality of the additive storage 103-107, additive storage selectors 111, storage openers 113, storage combiner 115, combining mechanism 117, additive storage content combiner 119, and the base liquid storage 121.

The additive storage selector 111 is a mechanism which is used to select a particular additive into the additive storage content combiner or a base liquid container (i.e. soft drinks can or a bottle). The type of the contents in the additive storage 103-107 will be the types which impart a specific, taste, flavor, chemical nature, preservative quality, etc. The additive storage selector 111 is a mechanism for selecting the additives. The selector mechanism can be a simple tap actuated in one of the two ways, manual or automatic. The flow is monitored though a measurement scale. If the flow is automatic, sensors are used in a manufacturing environment. The amount of the additive flow will be set predetermined. An additive of same taste/flavor of different concentrations will also be selected.

The storage opener 113 is a mechanism which is used in filling the storages by the respective additives from external containers. The opener 113 can be one of the two ways, manual or automatic. The quantity of the additives depletes when the additives is completely flowed out, necessitating the refilling. The storage combiner 115 is a mechanism which helps in combining the storages together; more storage can be added or removed depending on the type of soft drinks.

The combining mechanism 117 facilitates the way in which the additives and the base liquid are combined together. In one embodiment of the present invention the additives are combined together through a proportionate release of different additives into the additive storage content combiner 119, resulting in an additive mixture. Subsequently the additive mixture so obtained in 119 is released into the base liquid container resulting in soft drinks. The releasing of the additives into the additive content storage combiner is facilitated by the combining mechanism 117.

In another embodiment of the present invention the combining mechanism 117 is incorporated into the container cap. A piercer (For example a sharp drinking straw) is used to tear the additive bags sandwiched and aligned with a cavity in the cap thereby combining the additive bag contents with the base liquid. In this mechanism selecting a plurality of the sandwiched additive bag is done by aligning the cavity by using a spinning and aligning mechanism with the piercer inline with a pierceable cavity. In this mechanism the piercer pierces the cavity (covered by a thin foil), additive bag and reaches all the way down till the underlying soft drinks. The soft drinks consumer shakes the can (or the bottle) to mix the newly added additives and the base liquid together which yields the consumable soft drinks.

The base liquid storage 121 is storage where the base liquid for the preparation of the soft drinks is stored. The base liquid from this storage will be released into a plurality of the base liquid containers.

Figure 2:
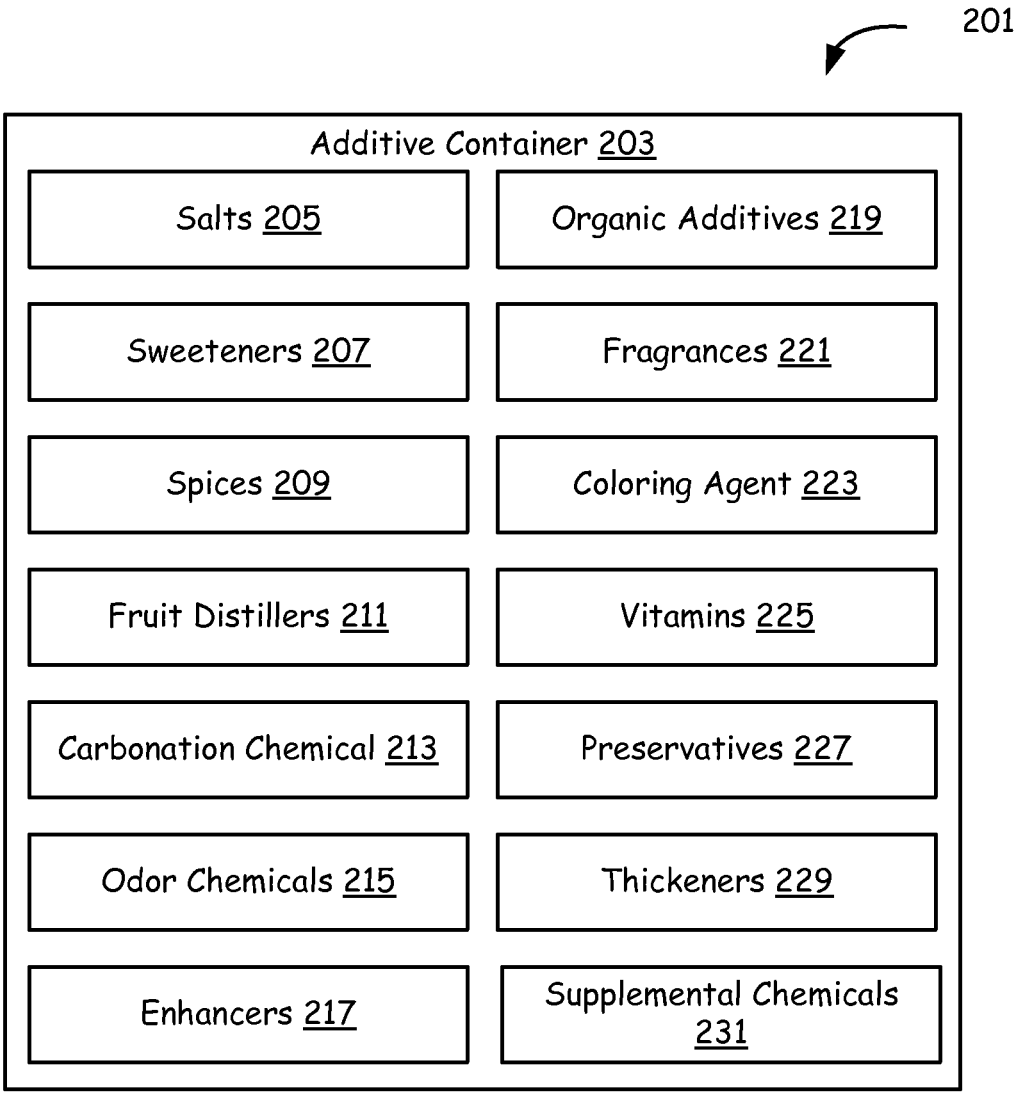
FIG. 2 is a diagram illustrating various exemplary additives tabulated that can be filled into additive storage of FIG. 1 in accordance with the present invention.

FIG. 2 is a diagram illustrating various exemplary additives tabulated that can be filled into additive storage 103-107 of FIG. 1 in accordance with the present invention. This diagram list of additives provides several options of tastes, flavors, fragrances, etc. that can be incorporated into the soft drinks. During the manufacture of the soft drinks each of the ingredients listed in FIG. 2 are stored in a separate additive storage. The additives stored in their storages are selected using the additive storage selector 111, releasing into the additive storage content combiner 119 or into the base liquid storage (container) 121 of FIG. 1.

The additive container 203 of FIG. 2 consists of a plurality of the ingredients which includes the salt contents 205. The salt contents can be any supplemental ingredients such as sodium chloride (common salt) to enhance or modify the taste of the soft drinks. Another ingredient such as sweeteners 207 are a substitute for the sugar. The sweeteners are an important ingredient which facilitates people with diabetes to consume the soft drinks without any worry.

Other ingredients are fruit distillers 211, carbonation chemicals 213, odor chemicals 215, enhancers 217, organics additives 219, fragrances 221, coloring agent 223, vitamins 225, preservatives 227, thickeners 229, and supplemental chemicals 231.

Spices 209 are strong tasting and strong smelling plant derived ingredients For example pepper powder, chili powder, Cumin powder, etc. that can be added into the soft drinks to change the taste. Fruit distillers 211 additives are derived from the fruits of specific variety. The carbonation dioxide chemicals 213 are for aerating the soft drinks. The carbonation chemical 213 releases carbon dioxide ($CO_2$) into the soft drinks. Odor chemicals 215 are special chemicals that attribute special odor into the soft drink. The enhancers 217 are special agents which will enhance particular character of the soft drinks, which can be natural or artificial in their taste or flavor.

The organics additives 219 are the organic derivatives from animals or plants For example cheese, ghee, creamer, sauce, etc. Fragrances 221 are the agents which releases aroma of specific type which will enhance the soft drinks so that the taste and flavor of soft drinks persists inside the mouth of the consumer even after drinking the soft drinks for a long time. The coloring agent 223 facilitates the required color for the soft drinks. The color of the soft drinks has a psychological effect on the soft drinks consumer. For example the orange taste/flavor soft drinks will have a natural feeling of drinking orange fruit juice if its color is same as the orange fruit juice.

Vitamins 225 are the vitality enhancing agents for the soft drinks. The preservatives 227 is an ingredient added into the soft drinks in order to keep the soft drinks from being spoiled by bacteria, fungi, etc. attack. Thickeners 229 ingredients are required to control the thickness of the soft drinks. Supplemental chemicals 231 are any ingredients that are liked by consumers based on the food habits of a given geographic region.

Figure 3:
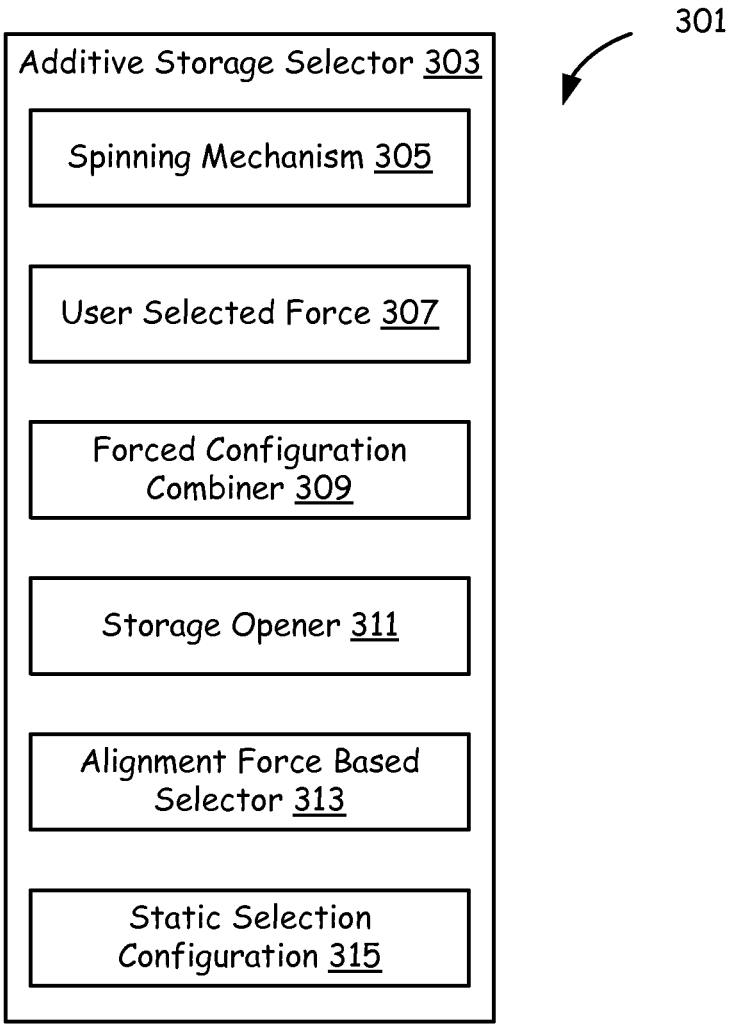
FIG. 3 is a block diagram illustrating various exemplary embodiments of the additive storage selector of FIG. 1 used in adding the additives into the base liquid in accordance with the present invention.

FIG. 3 is a block diagram illustrating various exemplary embodiments of the additive storage selector of FIG. 1 used in adding the additives into the base liquid in accordance with the present invention. The additive storage selector mechanism becomes very important depending on the context, For example during the manufacturing time of the soft drinks, time during serving the soft drinks to a large group of people, consumption of the soft drinks by sports community, consumption of the soft drinks by children, etc.

The additive storage selector 303 of FIG. 3 has different configuration mechanisms. Some of the mechanisms incorporated in various contexts of soft drinks preparation, delivery, or consumption are a spinning mechanism 305, user selected force 307, forced configuration combiner 309, storage opener 311, alignment force based selector 313, and static selection configuration 315.

The spinning mechanism 305 of selecting the additive storage is a configuration arrangement done in the cap of a container. The container cap will have a plurality of the additive bags with each one of them being associated with a cavity inside the container cap. On this container cap mounted is a dialing mechanism. When the consumer dials the dialing mechanism additive bags that are placed aligned with the cavity inside the cap of the container will be visible to the consumer. Subsequently the soft drinks purchaser uses a piercing mechanism (or a piercer such as a drinking straw) provided to him. He pierces the additive bag aligned with the cavity using the piercer which pierces all the way down through the cavity, additive bag and into the space inside the container. This action will release the additive into the container. The container will have the base liquid needed for the soft drinks. The spinning mechanism can be dialed by specified number of times to select the corresponding additive bag being placed aligned with the cavity, For example dialing one step aligns with orange flavor additives cavity, dialing twice may align apple flavor additive cavity, etc.

The user selected force 307 mechanism of additive storage selector is a generic representation of a plurality of configuration of additive bags that will be associated with an opener tab (i.e. a metal tab) on the container cap. In one of embodiment of the present invention the soft drinks consumer applies force on the opener tab. Applying force will pierce through and tear the additive bag releasing the additive contents into the underlying container. The spinning mechanism 305 and the user selected force 307 mechanisms for releasing the additives from the additive bags are suitable for the sport drinks.

Forced configuration combiner mechanism 309 used for additive storage selection and combining the additives giving an additive mixture. In this mechanism a person selects various alignments by the application of different amount of force. For example applying force-1 selects additive-1 by aligning its storage with the combiner, force-2 selects additive-2 by aligning its storage with the combiner, and so on with force-3 and additive-3, etc. Applying approximately a specific amount of force enables the opening of the corresponding additive into the additive storage content combiner 119 of FIG. 1.

In another embodiment of the present invention the storage opener 311 is used for selecting the additive storage for releasing the additives into the base liquid container or an additive storage content combiner 119 of FIG. 1. The storage opener 311 will have an opener tab in the cap of the base liquid container. Pulling the tab upward or pushing the tab downward will have different functionalities associated. Pulling the tab will function as an opening mechanism of the base liquid container. Pushing the tab makes it to squeeze an additive bag associated with the cap. By pushing the user is exerting force to select a specific quantity of the additive from the bag into the base liquid inside the container.

Another embodiment of the present invention describes an alignment force based selector 313 in which the additive bag or an additive storage are aligned with the cavity in the cap of the base liquid container. The additive storage or the additive bags are aligned externally on top of the cap and a force is applied just enough to open the cavity in the cap and subsequently release a specific quantity of the additives from the additive bag into the base liquid container. A specific embodiment of the alignment force based selector is described in FIG. 9 in the subsequent sections. A slot on top of the base liquid container cap will help in aligning the additive bag inline with the cavity of the cap.

The static selection configuration 315 is another configuration of the additive storage selector 303. In this mechanism the person does the decision by way of reading the label over an additive storage and release the additive in an explicit manner, for e.g. use a tap or select a cavity associated with additive bag and pierce a drinking straw to release the additive. The selection of the additives is also done typically by an explicit selection of different doses of an additive content, such as strong, medium, light concentration, etc.

Figure 4:
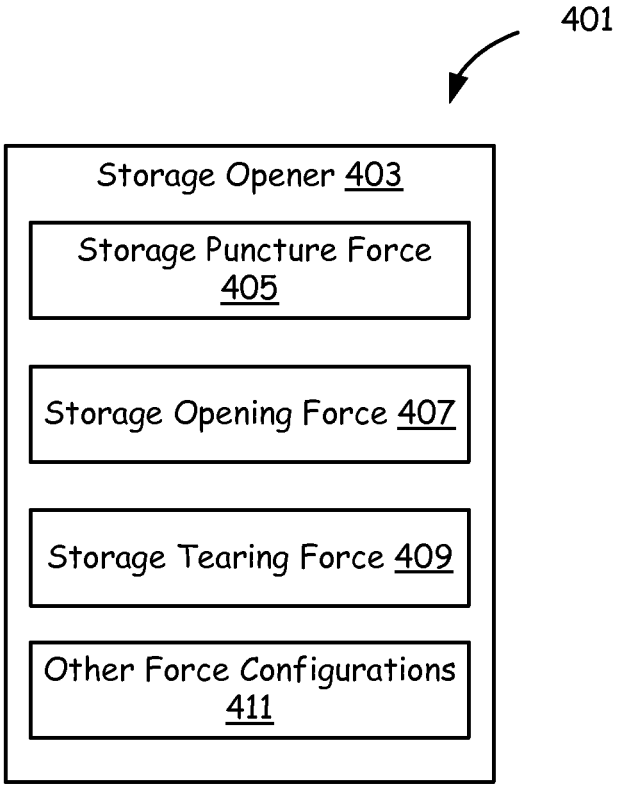
FIG. 4 is a block diagram illustrating various storage opener force configurations to release additive storage content into the base liquid storage of FIG. 1 in accordance with the present invention.

FIG. 4 is a block diagram illustrating various storage opener force configurations to release the additive storage content into the base liquid storage 121 of FIG. 1 in accordance with the present invention. The storage opener 403 is a mechanism which does the functionality of the additive storage selector 303 of FIG. 3. A storage opener in accordance with the present invention is for doing the functionality of selecting the additive storage, combining the additive storage and releasing the additive contents into the base liquid container or a base liquid storage 121 of FIG. 1. The components of the storage opener 403 are the storage puncture force 405, storage opening force 407, storage tearing force 409, and other force configurations 411.

The storage puncture force 405 is required to puncture the additive bag which is associated (being sandwiched) with the cap of the base liquid storage 121 of FIG. 1, in a specific embodiment of the present invention. The storage opening force 407 is the force required to open the cavity of the base liquid storage. The force required are the pushing and pulling for puncturing the additive bag and opening the cavity, respectively.

The storage tearing force 409 is required to tear the additive bag to release the additive contents into the base liquid container (or storage 121 of FIG. 1). There are other force configurations 411 For example applying the force on the handle of the base liquid container to squeeze the additive bag to release the additive contents, etc.

Figure 5:
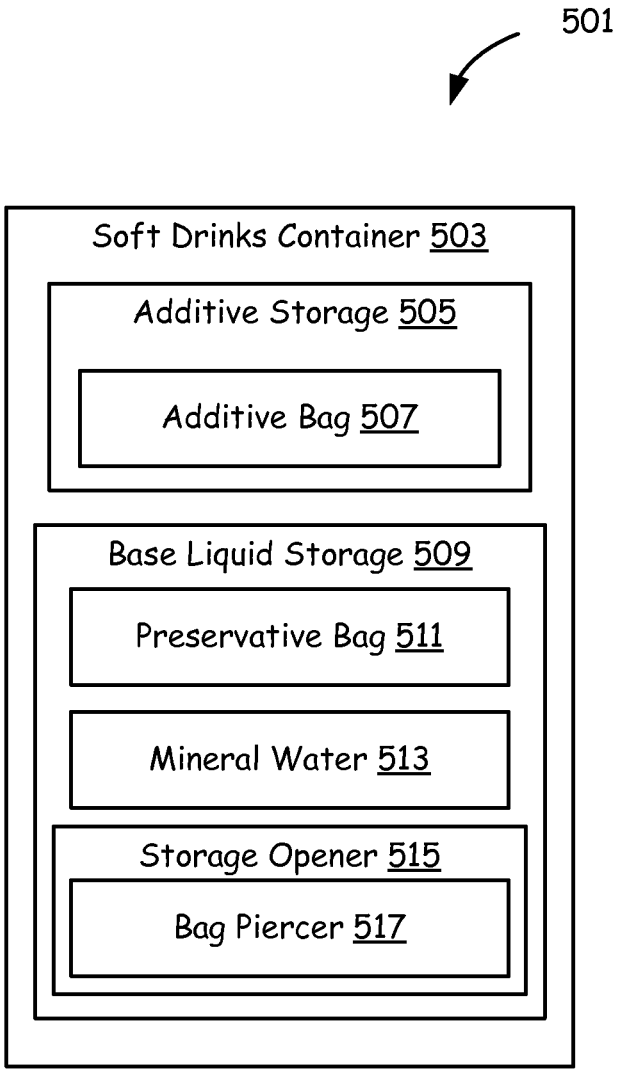
FIG. 5 is a block diagram of one of the embodiment of the soft drink container of FIG. 1 in accordance with the present invention.

FIG. 5 is a block diagram of one specific embodiment of the soft drink container of FIG. 1 in accordance with the present invention. The soft drink container 503 (101 of FIG. 1 repeated as a specific embodiment) has an additive storage 505 and a base liquid storage 509. The additive storage 505 contains an additive bag 507 in one embodiment of the present invention. The additive storage 505 will be an additive bag container to be discussed in FIG. 8, containing an additive bag in aligned with the cap of the soft drink container 503. The base liquid storage 509 has preservative bag 511, mineral water 513, and the storage opener 515 for selecting and releasing the additive content into the base liquid inside the base liquid container discussed in the context of the FIG. 8, FIG. 9, and FIG. 10 subsequently.

The base liquid is prepared by mixing the basic ingredients such as preservatives contained in the preservative bag 511, and the mineral water 513 inside the base liquid storage 509. The base liquid storage 509 is sealed by a cap that has suitable mechanism for holding the additive bag aligned with a pierceable cavity (which facilitates the hole for dispensation of the additives). The preservative bag associated with the cap aligned with (another) cavity hole. A piercer pierces the preservative bag 511 and releases the preservatives into the mineral water present in the base liquid storage 509.

The additives when released into the base liquid storage 509 that has the preservative and mineral water 513 results in a soft drinks. Addition of other ingredients such as sweeteners (207), fragrances (221), fruit distillers (211), thickeners (229), enhancers (217), etc. will enhance the taste and flavor to the likings of the consumer. In one embodiment of the present invention adding of all the required ingredients is done by the consumer of the soft drinks to his taste following a simple recipe described on the base liquid container.

Figure 6:
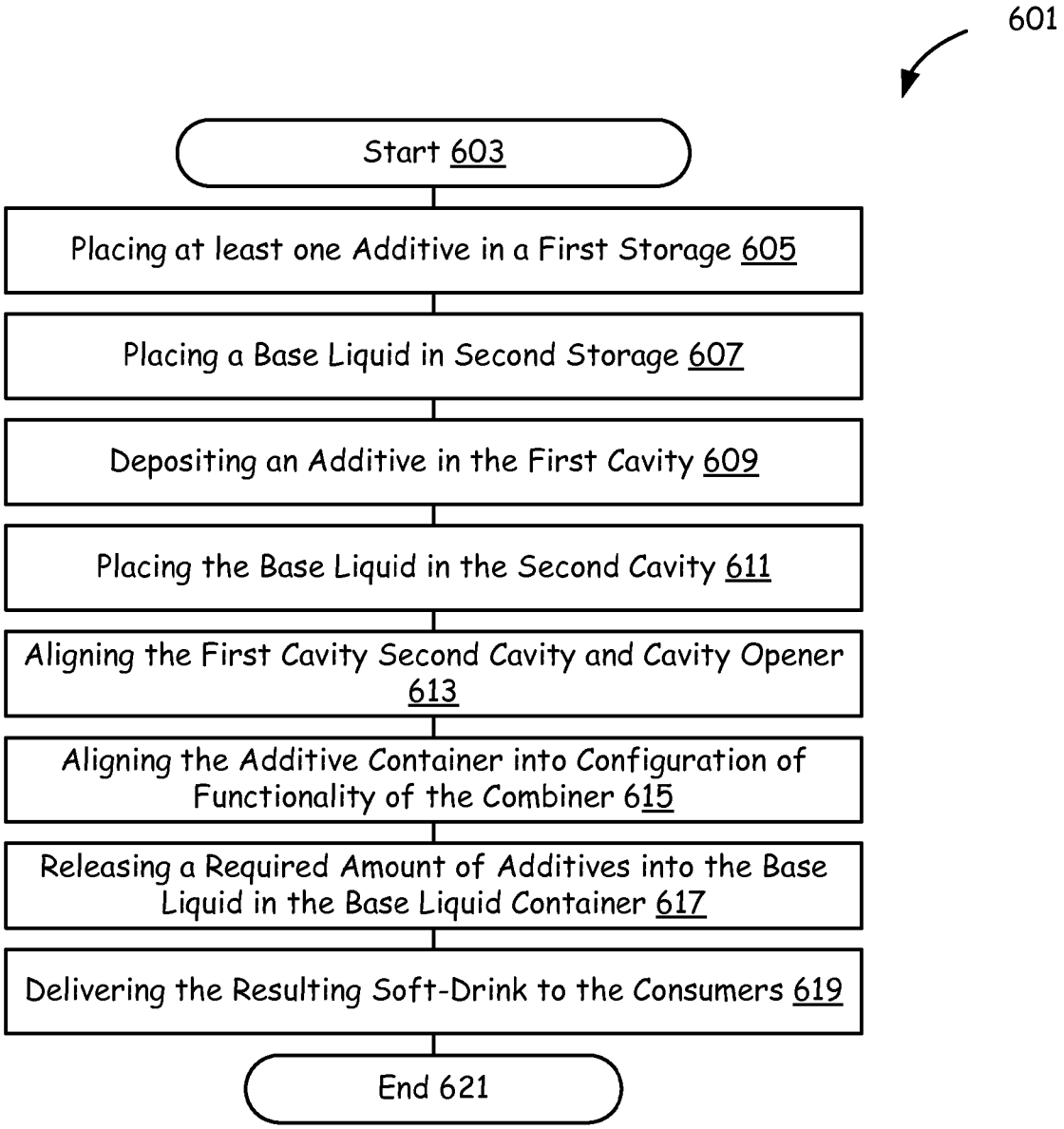
FIG. 6 is a flowchart for the method performed in manufacturing and delivering fresh soft drinks in accordance with the present invention.

FIG. 6 is a flowchart for the method performed in manufacturing and delivering fresh soft drinks in accordance with the present invention. The method involves a fresh mixing of various ingredients which are stored in different additive storage on a storage combiner 115 of FIG. 1. A storage opener 113 of FIG. 1 facilitates storage of various ingredients that are required to prepare or manufacture soft drinks of different taste and flavor. In one embodiment of the present invention all the ingredients are allowed to flow though additive storage selector 111 mechanism on the additive storage content combiner 121 of FIG. 1.

The base liquid will be prepared by adding mineral water and preservatives inside a storage combiner or a container such as a can or bottle. If it is the storage combiner 115 of FIG. 1, the composition of the base liquid that is flowed or released into various cans or bottles will be same. In case of mixing mineral water and preservatives the ratio of the ingredients varies from can to can or bottle to bottle depending on the accuracy of the release mechanisms of these ingredients (FIG. 2).

Mixing ingredients in containers like cans or bottle can be used for customization of taste and flavor, whereas mixing them inside storage combiner 115 of FIG. 1 can be done during serving a large group people for the ease of serviceability. Also in the manufacturing plant, mixing the basic ingredients inside a storage combiner 115 of FIG. 1 will be used for the purpose of ease/simplicity and quality control.

Starting at 603, at the next block 605 an additive is placed in the first additive storage container and in the subsequent block 607 the base liquid is placed in the second additive storage container. The base liquid is obtained by adding the preservative into the mineral water; the base liquid is further mixed with variety of additives to yield consumable soft drinks. The preparation of the base liquid follows simple steps of placing the required quantity of the mineral water in one of the storage (or a container), tearing the preservative bag, and adding it into the mineral water container results in the base liquid in the same container or storage.

At the block 609 the additive is deposited on the first cavity of a cap (of a base liquid container). In one embodiment of the present invention the cavity is a separate container which can store a specified amount of soft drinks deposited for its subsequent release into the can or a bottle. The size of the cavity will be a measuring unit of an ingredient such as base liquid, additives, etc.

In another embodiment of the present invention the cavity is a part of the cap of a soft drink container such as a soft drinks can or bottle. Its function here is to permit the flow of the various additive mixtures into the can/bottle through a hole made through it using a piercing mechanism. The piercing mechanism is a cavity opener for example a drinking straw in its simplest form. Following the placement of the additive in the first cavity at the block 609, the base liquid is deposited in the second cavity at the block 611. This deposition facilitates the release of the base liquid into the soft drinks can/bottle (i.e. a container).

Subsequent to the deposition of the base liquid into the second cavity at the block 611, in the next block 613 the first cavity, second cavity and cavity opener are aligned so as to select the required additive storage to release a specific quantity. In the next block 615 the additive containers are configured into (or placed on) a storage combiner (115 of FIG. 1). In the next block 617 the additives are released into the additive storage content combiner 119 of FIG. 1 in one embodiment of the present invention and into the base liquid container in another specific embodiment of the present invention.

On releasing the additive contents from the additive storage or additive mixture from the additive storage content combiner 119 of FIG. 1 into the soft drink containers For example cans/bottles the cans/bottles are delivered to the consumers at the block 619 to end the process at the last block 621.

Figures 7A, 7B:
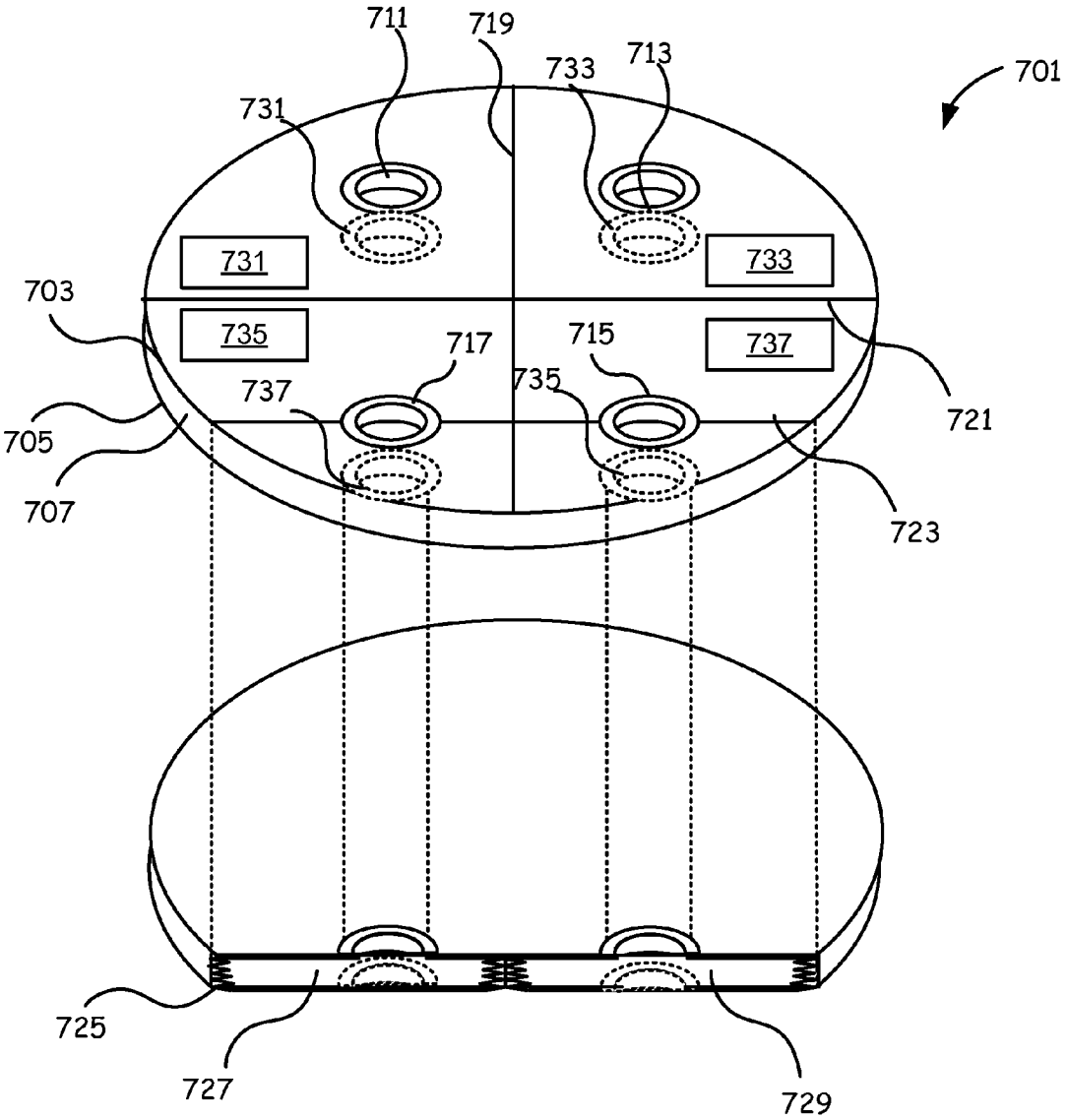
FIGS. 7A and 7B are exemplary diagrams of a specific embodiment of the additive selector using cavity alignment in accordance with the present invention.

FIGS. 7A and 7B are exemplary diagrams of a specific embodiment of the additive selector using cavity alignment in accordance with the present invention. In this figure the cap of the can/bottle is shown with multiple cavities. These cavities are associated with additive bags sandwiched between two thin plates with sealed holes that constitute part of the cap. The sealed holes are aligned with the additive bag which is sandwiched between the two plates. A piercer such as a drinking straw is used to pierce through the cavity holes tearing the additive bag to release the additive content into the underlying base liquid in the space inside the can/bottle.

In the FIG. 7A, 703 is the upper plate and 705 is the lower plate both of them forming part of the cap 707. The upper plate 703 has 711, 713, 715, and 717 as the cavity (holes kept sealed) with a thin foil. Similarly 731, 733, 735, and 737 are the cavity holes sealed in the lower plate 705. A pair of perpendicular lines 719 and 721 divides the cap (plates) into 4 quadrants in this exemplary FIG. 7A to associate at least four additive bags inside the cap, one each in the quadrants.

FIG. 7B is the cut view of the cap of FIG. 7A along the cut line 723 of FIG. 7A. In the cut view two out of four of the additive bags 727 and 729 that are sandwiched between the plates 703 and the 705 are visible aligned with the cavity holes 717 & 737 and 715 & 735 respectively.

All the four additive bags have labels 731, 733, 735, and 737 written their taste/flavor, as shown in FIG. 7A. The soft drinks consumer will make choice of the particular additive by reading the labels. He uses a cavity piercing mechanism such as an external drinking straw for tearing the additive bag. By piercing the cavity he will tear the additive bag and the cavity holes till the straw reaches the space of underlying base liquid in the container. Subsequently he will shake the can/bottle to mix the additives thoroughly with the base liquid that turns the base liquid into the soft drinks.

In the process of piercing and releasing the additives the consumer has multiple choices to add multiple ingredients. The consumer adds adequate sweetener into the base liquid of his choice. This is an essential feature for the consumers who are diabetic with sweet and salt restricted in their food and drinks.

Figure 8:
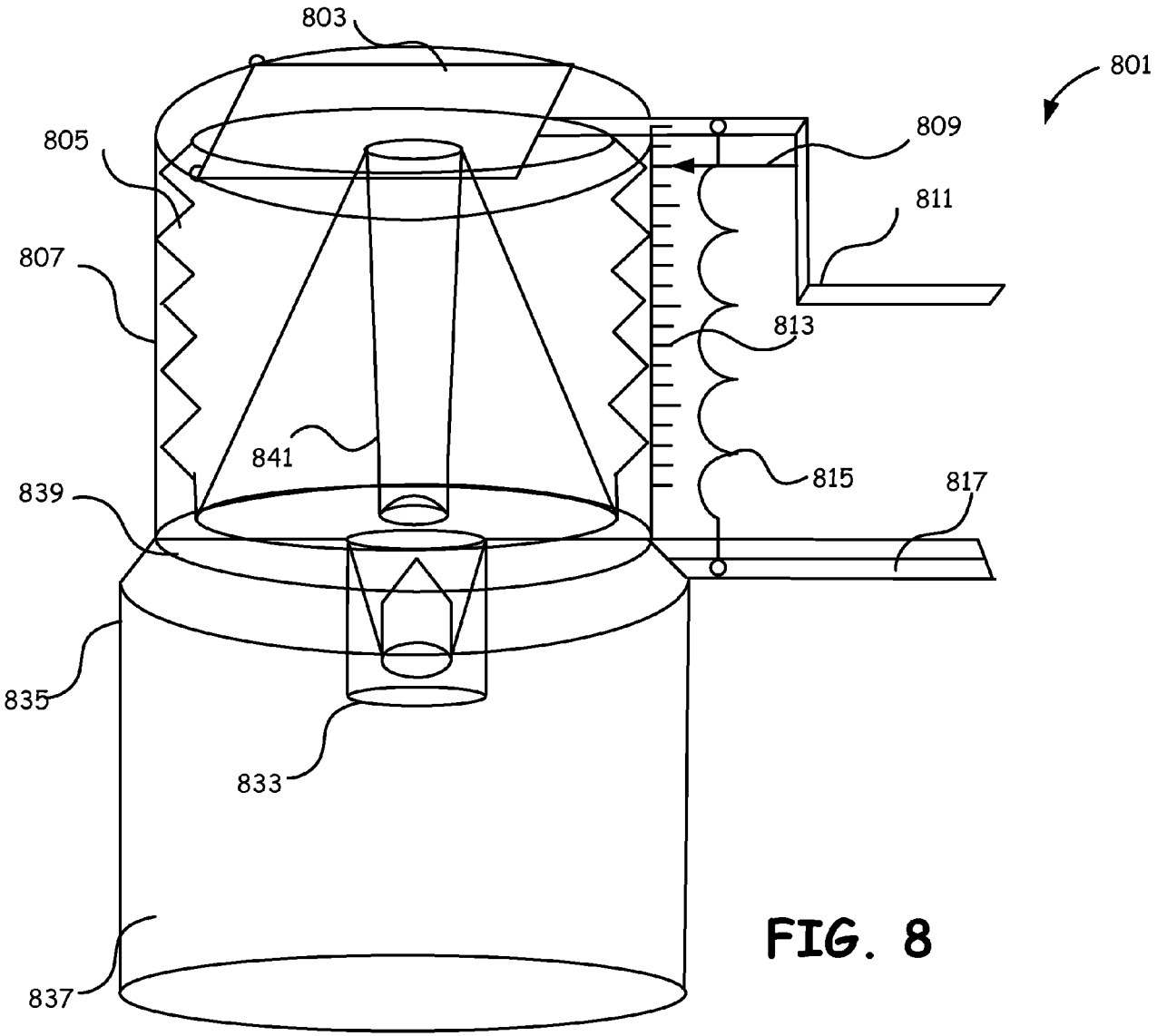
FIG. 8 is a perspective diagram showing the release of the additives by the application of external force on the additive bag placed in an alignment with a cavity in the cap of the base liquid container in accordance with one specific embodiment of the present invention.

FIG. 8 is a perspective diagram showing the release of the additives by the application of external force on the additive bag placed in an alignment with a cavity (hole) in the cap of the base liquid container in accordance with one specific embodiment of the present invention. The configuration 801 of FIG. 8 exemplifies the release of additives by the application of an external force on the container handle 811.

The additive bag 805 will be placed inside an additive bag container 807. The additive bag container has a provision to cover its top with a flap 803 coupled with the handle 811. Applying force on this handle squeezes the additive bag 805 inside the additive bag container 803. The additive bag has a piercing nozzle 841 which aligns automatically with the pierceable cavity 833 of the cap 839 of the base liquid container by the virtue of its placed orientation inside its container 807. The additive bag container 807 is fixed on top of the base liquid container 835 (cap 839).

The additive bag container 807 is in the form of a cylinder with the open end which can be screwed (or fitted) on top of the base liquid container cap 839. The other end of the cylinder carries the flap 803 which can be flipped by 180° into two positions. In one position (i.e. 0° position) it closes the additive bag container 807 and in other 180° position it opens the additive bag container. On opening the additive bag container the additive bag 805 will be dropped with the orientation shown in FIG. 8 after which the additive bag container will be closed again by turning the flap 803 to 0° position.

The additive bag container 807 has other features such as a scale 813 for measuring the quantity of the additive content released from the additive bag 805 into the base liquid container 835 and a restoring spring 815 that restores the position of the flap after squeezing the additive bag 805, and 809 is the scale marker coupled with the handle 811. The handle 811 coupled with the flap 803 and another handle 817 coupled with the base liquid container 835 facilitates a means of exerting force using palm (i.e. using finger grip) on the additive bag 805. On the exertion of the force on the handles 811 and 817 the additive bag 805 squeezes and upon this the piercer nozzle 841 pierces the cavity 833 (hole) on the cap 839 of the base liquid container 835 opening it. This piercing action opens a hole in the cavity 833 and the additive content from the additive bag 805 flows into the base liquid (space) 837 contained in container 835. Thus, mixing of the base liquid and the additives results in a fresh soft drink.

In using the additive selector and release mechanism of the FIG. 8, a consumer or a soft drinks server peels off thin foil on top of the cap 839 of the base liquid container 835. He will fit the additive bag container 807 on top of the cap 839. Next, he will place the additive bag 805 inside the additive bag container 807. He will place the flap 803 in the normal (0°) position and apply force on it through the handle 811 and 817 using his palm. This force gradually squeezes the additive bag 805 forcing the additive content through the additive nozzle 841; thus releasing the additive contents into the base liquid container through the cavity hole 833. The resulting soft drinks is consumed the by preparer or served/distributed to a group of people (consumers). The structure and mechanism of this specific embodiment of the additive bag are discussed in more detail in FIG. 9.

Figure 9:
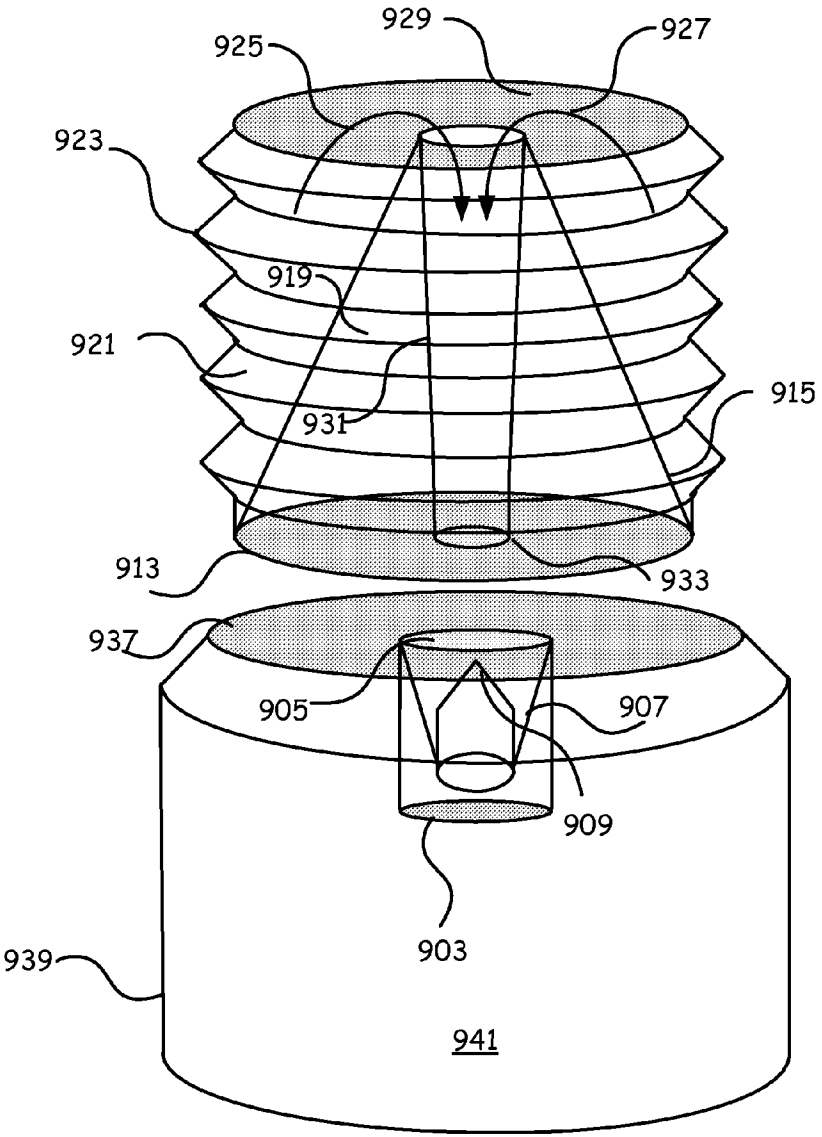
FIG. 9 is a diagram of a specific embodiment of an additive bag used to deliver the additives in the configuration of FIG. 8 in accordance with the present invention.

FIG. 9 is a diagram of a specific embodiment of an additive bag used to deliver the additives in the configuration of FIG. 8 in accordance with the present invention. The additive bag 923 and the cavity 905 (833 of FIG. 8 repeated) in the cap 937 (839 of FIG. 8 repeated) shown in FIG. 9 are compatible to each other in realizing the functionality of releasing the additive content into the base liquid contained in its container. The additive bag 923 is basically a container with its outer body a corrugated structure easy to fold and collapse when forced on top plate 929 of the additive bag 923.

The piercer nozzle 931 (841 of FIG. 8 repeated) is held in vertical position by a conical structure 915 and a bottom thin foil 913. The piercer nozzle 931 and the conical structure 915 are sufficiently hard compared to the corrugated outer wall of the additive bag 923. When an external force is applied on the top plate 929 of the additive bag 923 the outer corrugated wall folds and in this process due to the differing height of the corrugated wall and the piercer nozzle, the piercer nozzle projects outward by tearing the lower thin foil 913.

The additive bag 923 has two areas viz. the additive pouch 921 containing the additive content and the area 919 containing the air. During application of the force on the top plate 929 the additive filled in the additive pouch 921 contracts and forces the additive to flow out following the paths 925 and 927 into the piercer (nozzle) 931.

The piercer nozzle tip is 933 is covered and protected by a thin foil to avoid any leakage of the additives from the additive bag. The piercer nozzle tip stands perpendicular to the bottom sealing due to another foil 913. The additive bag is placed vertically on top of a base liquid container 939 aligned with the cavity 905 on top of the cap 937. After placing the additive bag on top of the additive container, the consumer or a person applies force using his palm on the top plate 929 which results in tearing the foil 913 and a thrust exerted on the cavity.

A short sufficiently sharp projection 909 from cavity tears the seal 933 on the tip of the piercer nozzle 931. A further force applied on the additive bag top plate 929 results in tearing of the sharp projection 909 and along with a conical (structured) holder 907. The torn 909 and 907 components falls into the space 903 inside the cavity allowing the easy flow of the additive contents into the underlying base liquid 941, resulting the fresh soft drinks in accordance with the present invention. As the sharp projection and its conical holder 907 are not falling into the base liquid after tear off, it's an advantage from hygiene perspective in accordance with the present invention.

Figure 10:
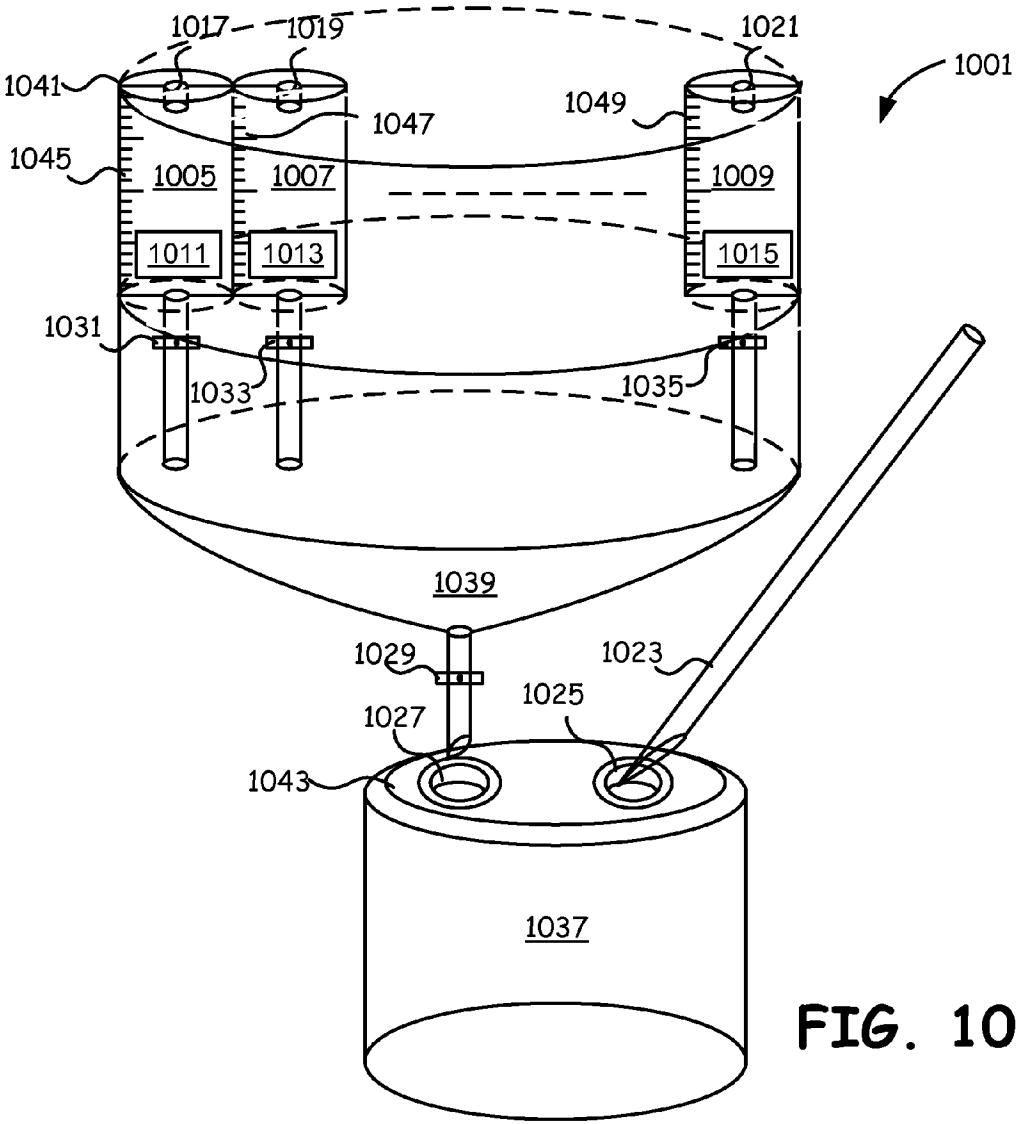
FIG. 10 is an exemplary diagram illustrating the mixing of the additives using a combiner to release the resulting mixture into the base liquid container in accordance with the present invention.

FIG. 10 is an exemplary diagram illustrating the additive mixing using a combiner to release the resulting mixture into the base liquid container in accordance with the present invention. In one of the embodiment of the present invention the additive storage combiner shown in FIG. 10 is a part of the soft drinks manufacturing plant and in another embodiment of the present invention the set of the FIG. 10 is installed in party or a gathering (get together) wherein a consumer will select and release a preset amount of the additive contents to his liking.

In a manufacturing environment a plurality of the additive storage are combined into an assembly called storage combiner 1041 (115 of FIG. 1 repeated). The additive storage combiner 1041 has the additive storage 1005-1009. Each of the additive storage carry labels 1011-1015 which has description of the type of the taste/flavor and chemical nature of its contents, etc. The additives are filled into these storages using the storage openings 1017-1021. The selector mechanism in this specific embodiment is the taps 1031-1035 along with the labels 1011-1015.

The additive storage 1005-1009 containers can be replaced with the similar ones in case of any need. The storage combiner 1041 has an additive storage content combiner 1039 which has plurality additive inlets through the taps 1031-1035. The tap operation mechanism may be manual or automatic. The recipe for particular soft drinks will be preset in the case of the automatic additive selections.

The additives that flow into the additive storage content combiner 1039 will form an additive mixture. A controlled amount of the additive mixture will be released into the base liquid container 1037 using another tap mechanism 1029. The release of the additive mixture into the base liquid container is through a pierceable cavity 1027. In one embodiment of the present invention the soft drinks consumer will drink the soft drinks using the drinking straw 1023 through another pierceable cavity 1025. In another embodiment the cavity hole formed during the additive mixture release will be used for consuming the soft drinks also.

In the manufacturing environment an open base liquid container (or can/bottle) without cap 1043 will be used to fill the additive mixture after which the container will be sealed with the cap 1043. After sealing the soft drinks can/bottle is ready to be delivered.

In this process the additive storage 1005-1009 are filled with the additive contents by opening the storages through the storage openers 1017-1021. In the next step the additive selector mechanism is used to release a specific amount of the additive into the additive storage content combiner 1039. This requires piercing the base liquid container cavity to form hole through the additive mixture will be released into the base liquid container.

A specified amount of the additive contents are released into the additive content combiner using the measurement scale 1045-1049.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

The present invention has been described above with the aid of functional building blocks illustrating the performance of certain significant functions. The boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention.

One of average skill in the art will also recognize that the functional building blocks, and other illustrative blocks, modules and components herein, can be implemented as illustrated or by discrete components, application specific integrated circuits, processors executing appropriate software and the like or any combination thereof.

Moreover, although described in detail for purposes of clarity and understanding by way of the aforementioned embodiments, the present invention is not limited to such embodiments. It will be obvious to one of average skill in the art that various changes and modifications may be practiced within the spirit and scope of the invention, as limited only by the scope of the appended claims.

What is claimed is:

1. An apparatus comprising:

a plurality of additive storage cavities configured to contain a plurality of respective additive substances, each additive storage cavity comprising:

a top sealed by an upper thin plate, the upper thin plate includes an upper sealed hole spanning a limited portion of the upper thin plate, a bottom sealed by a lower thin plate, the lower thin plate includes a lower sealed hole spanning a limited portion of the lower thin plate and substantially vertically aligned with the upper sealed hole, each of the upper sealed hole and the lower sealed hole are configured to be punctured by a cavity piercing mechanism, and each additive storage cavity is configured to guide the cavity piercing mechanism to pass vertically through the additive storage cavity via puncture of the upper sealed hole and the lower sealed hole;

a container storing carbonated water coupled to the plurality of additive storage cavities, the container sealed at its top by a puncturable upper surface; and the apparatus configured to release a selected additive substance from a selected additive storage cavity into the container by receiving the cavity piercing mechanism to pass vertically through the selected additive storage cavity into the container.

2. The apparatus of claim 1, wherein:

a first additive storage cavity contains a first flavoring; and a second additive storage cavity contains a second flavoring.

3. The apparatus of claim 2, wherein at least one of the first flavoring and second flavoring are liquids.

4. The apparatus of claim 1, the cavity piercing mechanism comprises a drinking straw.

5. The apparatus of claim 1, wherein a first additive storage cavity contains at least one liquid vitamin.

6. The apparatus of claim 1, wherein a first additive storage cavity contains a liquid sweetener.

7. The apparatus of claim 1, wherein a first additive storage cavity contains a liquid thickener.

8. The apparatus of claim 1, wherein a first additive storage cavity contains a liquid fragrance.

9. The apparatus of claim 1, wherein the plurality of additive storage cavities permanently attach to the container.

10. The apparatus of claim 1, wherein the plurality of additive storage cavities rotatingly attach to the container.

11. An apparatus comprising:

two additive storage cavities configured to contain respective additive substances, each additive storage cavity comprising:

a top sealed by an upper thin plate, the upper thin plate includes an upper sealed hole spanning a limited portion of the upper thin plate, a bottom sealed by a lower thin plate, the lower thin plate includes a lower sealed hole spanning a limited portion of the lower thin plate and substantially vertically aligned with the upper sealed hole, each of the upper sealed hole and the lower sealed hole are configured to be punctured by a cavity piercing mechanism, and each additive storage cavity is configured to guide the cavity piercing mechanism to pass vertically through the additive storage cavity via puncture of the upper sealed hole and the lower sealed hole;

a container storing carbonated water coupled to the two additive storage cavities, the container sealed at its top by a puncturable upper surface; and the apparatus configured to release a selected additive substance from a selected additive storage cavity into the container by receiving the cavity piercing mechanism to pass vertically through the selected additive storage cavity into the container.

12. The apparatus of claim 11, wherein:

a first additive storage cavity contains a first flavoring; and a second additive storage cavity contains a second flavoring.

13. The apparatus of claim 12, wherein at least one of the first flavoring and second flavoring are liquids.

14. The apparatus of claim 11, the cavity piercing mechanism comprises a drinking straw.

15. The apparatus of claim 11, wherein a first additive storage cavity contains at least one liquid vitamin.

16. The apparatus of claim 11, wherein a first additive storage cavity contains a liquid sweetener.

17. The apparatus of claim 11, wherein a first additive storage cavity contains a liquid thickener.

18. The apparatus of claim 11, wherein a first additive storage cavity contains a liquid fragrance.

19. The apparatus of claim 11, wherein the two additive storage cavities permanently attach to the container.

20. The apparatus of claim 11, wherein a first additive storage cavity contains a salt.

* * * * *